US009782784B2

(12) United States Patent
Schmon et al.

(10) Patent No.: US 9,782,784 B2
(45) Date of Patent: Oct. 10, 2017

(54) NOZZLE HEAD FOR A SPRAY DEVICE

(75) Inventors: Ewald Schmon, Grafenberg (DE); Peter Dettlaff, Remseck (DE)

(73) Assignee: SATA GMBH & CO. KG, Kornwestheim (DE)

( * ) Notice: Subject to any disclaimer, the term of this patent is extended or adjusted under 35 U.S.C. 154(b) by 348 days.

(21) Appl. No.: 13/698,417

(22) PCT Filed: May 21, 2011

(86) PCT No.: PCT/EP2011/002544

§ 371 (c)(1),
(2), (4) Date: Nov. 16, 2012

(87) PCT Pub. No.: WO2011/147555

PCT Pub. Date: Dec. 1, 2011

(65) Prior Publication Data

US 2013/0056556 A1 Mar. 7, 2013

(30) Foreign Application Priority Data

May 28, 2010 (DE) ..... 20 2010 007 355 U

(51) Int. Cl.
*B05B 7/00* (2006.01)
*B05B 7/06* (2006.01)
(Continued)

(52) U.S. Cl.
CPC ..... *B05B 7/064* (2013.01); *B05B 7/025* (2013.01); *B05B 7/0815* (2013.01)

(58) Field of Classification Search
CPC ..... B05B 7/064; B05B 7/0815; B05B 7/062; B05B 7/066; B05B 7/025; B05B 7/0861
(Continued)

(56) References Cited

U.S. PATENT DOCUMENTS 40,433 A 10/1863 Sees
327,260 A 9/1885 Hart
(Continued)

FOREIGN PATENT DOCUMENTS

AT 153883 6/1997
AT 163577 3/1998
(Continued)

OTHER PUBLICATIONS

International Preliminary Report on Patentability and Written Opinion dated Dec. 4, 2012 for PCT/EP2011/002544.
(Continued)

*Primary Examiner* — Jason Boeckmann
(74) *Attorney, Agent, or Firm* — Paul D. Bianco; Gary S. Winer; Fleit Gibbons Gutman Bongini & Bianco, PL

(57) ABSTRACT

The invention relates to a nozzle head for a spray device, comprising a central material nozzle, an air ring nozzle surrounding said material nozzle, and preferably at least two laterally projecting horns, into each of which at least one horn air nozzle is incorporated, and optionally comprising a material-conducting needle, characterized in that at least one nozzle (3, 3*a*, 3*b*, 5, 5*a*, 12, 12*a*, 12*b*, 15, 16, 17, 17*a*, 17*b*, 17*c*, 18, 18*a*, 18*b*1, 18*b*2, 18*b*3, 300*a*, 300*b*), preferably at least one horn air nozzle (15, 16, 17, 17*a*, 17*b*, 18, 18*a*, 18*b*1, 18*b*2, 18*b*3, 300*a*), has a non-cylindrical shape.

25 Claims, 17 Drawing Sheets

(51) Int. Cl.
*B05B 7/02* (2006.01)
*B05B 7/08* (2006.01)

(58) Field of Classification Search
USPC ..... 239/290, 291, 292, 294–297, 299
See application file for complete search history.

(56) References Cited

U.S. PATENT DOCUMENTS 459,432 A 9/1891 Anderson
459,433 A 9/1891 Avery
548,816 A 10/1895 Paul
552,213 A 12/1895 Troy
552,715 A 1/1896 Lugrin
563,505 A 7/1896 McCornack
581,107 A 4/1897 Emery
644,803 A 3/1900 Justi
672,012 A 4/1901 Ruper
574,880 A 5/1901 Schmidt et al.
1,662,496 A 3/1928 Forsgard
1,703,383 A 2/1929 Birkenmaier
1,703,384 A 2/1929 Birkenmaier
1,711,221 A 4/1929 Blakeslee
1,751,787 A 3/1930 Binks
1,889,201 A 11/1932 Holveck
2,008,381 A 7/1935 Beeg
2,049,700 A 8/1936 Gustafson
2,051,210 A 8/1936 Gustafsson
2,070,696 A 2/1937 Tracy
2,116,036 A 5/1938 Money
2,125,445 A * 8/1938 Holveck ..... B05B 1/042 239/599
2,198,441 A 4/1940 Mollart
2,204,599 A 6/1940 Jenkins
2,269,057 A 1/1942 Jenkins
D133,223 S 7/1942 Tammen
2,356,865 A 8/1944 Mason
2,416,856 A 3/1947 Thomsen
2,416,923 A 3/1947 Jenkins
2,557,593 A 6/1951 Bjorkman
2,557,606 A 6/1951 Liedberg
2,559,091 A 7/1951 Reasenberg
2,609,961 A 9/1952 Sapien
2,612,899 A 10/1952 Webb
2,646,314 A 7/1953 Peeps
2,721,004 A 10/1955 Schultz
2,844,267 A 7/1958 Petriccione
2,886,252 A 5/1959 Ehrensperger
3,090,530 A 5/1963 Peeps
3,159,472 A 12/1964 Revell
D200,594 S 3/1965 Sass
3,240,398 A 3/1966 Dalton, Jr.
D204,306 S 4/1966 Hamm
D205,760 S 9/1966 Hocutt et al.
D208,903 S 10/1967 Zadron et al.
3,344,992 A 10/1967 Norris
3,381,845 A 5/1968 MacDonald
3,417,650 A 12/1968 Varrin
3,420,106 A 1/1969 Keller et al.
3,435,683 A 4/1969 Keller et al.
3,482,781 A 12/1969 Sharpe
D217,928 S 6/1970 Felske
3,524,589 A 8/1970 Pelton, Jr.
3,527,372 A 9/1970 Manning
3,583,632 A 6/1971 Shaffer
3,622,078 A 11/1971 Gronert
3,645,562 A 2/1972 Fandetti et al.
3,656,493 A 4/1972 Black et al.
3,714,967 A 2/1973 Zupan et al.
3,746,253 A 7/1973 Walberg
3,747,850 A 7/1973 Hastings et al.
3,771,539 A 11/1973 De Santis
3,840,143 A 10/1974 Davis et al.
3,848,807 A 11/1974 Partida
3,857,511 A 12/1974 Govindan
3,870,223 A 3/1975 Wyant
3,873,023 A 3/1975 Moss et al.
4,000,915 A 1/1977 Strom
D245,048 S 7/1977 Pool
D252,097 S 6/1979 Probst et al.
4,160,525 A 7/1979 Wagner
4,210,263 A 7/1980 Bos
4,273,293 A 6/1981 Hastings
4,411,387 A 10/1983 Stern et al.
4,478,370 A 10/1984 Hastings
D276,472 S 11/1984 Harrison
D278,543 S 4/1985 Gintz
4,545,536 A 10/1985 Avidon
4,562,965 A 1/1986 Ihmels et al.
4,580,035 A 4/1986 Luscher
4,585,168 A 4/1986 Even et al.
4,614,300 A 9/1986 Falcoff
4,643,330 A 2/1987 Kennedy
4,653,661 A 3/1987 Buchner et al.
4,667,878 A 5/1987 Behr
4,713,257 A 12/1987 Luttermoller
D293,950 S 1/1988 Ogden et al.
4,730,753 A 3/1988 Grime
D298,372 S 11/1988 Taylor, Jr.
4,784,184 A 11/1988 Gates
4,806,736 A 2/1989 Schirico
4,826,539 A 5/1989 Harpold
4,832,232 A 5/1989 Broccoli
4,863,781 A 9/1989 Kronzer
4,877,144 A 10/1989 Thanisch
D305,057 S 12/1989 Morgan
4,887,747 A 12/1989 Ostrowsky et al.
4,901,761 A 2/1990 Taylor
4,906,151 A 3/1990 Kubis
4,917,300 A 4/1990 Gloviak et al.
4,946,075 A 8/1990 Lundback
4,964,361 A 10/1990 Aebersold
4,967,600 A 11/1990 Keller
4,969,603 A 11/1990 Norman
4,973,184 A 11/1990 La Salle
D314,421 S 2/1991 Tajima et al.
D314,588 S 2/1991 Denham
4,989,787 A 2/1991 Nikkel et al.
5,020,700 A 6/1991 Krzywdziak et al.
D318,877 S 8/1991 Miranda et al.
5,042,840 A 8/1991 Rieple et al.
D321,597 S 11/1991 Cerny
5,064,119 A 11/1991 Mellette
5,071,074 A 12/1991 Lind
5,074,334 A 12/1991 Onodera
5,078,323 A 1/1992 Frank
5,080,285 A 1/1992 Toth
5,088,648 A 2/1992 Schmon
5,090,623 A 2/1992 Burns et al.
5,102,045 A 4/1992 Diana
5,119,992 A 6/1992 Grime
5,125,391 A 6/1992 Srivastava et al.
5,135,124 A 8/1992 Wobser
5,143,102 A 9/1992 Blaul
5,165,605 A * 11/1992 Morita et al. ..... 239/296
5,170,941 A 12/1992 Morita et al.
5,190,219 A 3/1993 Copp, Jr.
5,191,797 A 3/1993 Smith
5,228,488 A 7/1993 Fletcher
5,232,299 A 8/1993 Hiss
5,236,128 A 8/1993 Morita et al.
5,249,746 A 10/1993 Kaneko et al.
5,289,974 A 3/1994 Grime et al.
5,322,221 A 6/1994 Anderson
5,325,473 A 6/1994 Monroe et al.
5,332,156 A 7/1994 Wheeler
5,333,506 A 8/1994 Smith et al.
5,333,908 A 8/1994 Dorney et al.
5,344,078 A 9/1994 Fritz et al.
5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,456,414 A 10/1995 Burns et al.

(56) References Cited

U.S. PATENT DOCUMENTS

D365,952 S 1/1996 Gagnon et al.
5,503,439 A 4/1996 LaJeunesse et al.
5,533,674 A 7/1996 Feyrer et al.
5,540,385 A 7/1996 Garlick
5,540,386 A 7/1996 Roman
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,695,125 A 12/1997 Kumar
5,704,381 A 1/1998 Millan et al.
5,718,767 A 2/1998 Crum et al.
D391,403 S 3/1998 Josephs
RE35,769 E 4/1998 Grime et al.
5,762,228 A 6/1998 Morgan et al.
5,803,360 A 9/1998 Spitznagel
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Endo
5,874,680 A 2/1999 Moore
5,874,708 A 2/1999 Kinsman et al.
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,250,567 B1 6/2001 Lewis et al.
6,276,616 B1 8/2001 Jenkins
D448,451 S 9/2001 Turnbull et al.
6,308,991 B1 10/2001 Royer
D457,599 S 5/2002 Karwoski et al.
D459,432 S 6/2002 Schmon
D459,433 S 6/2002 Schmon
6,402,058 B2 6/2002 Kaneko et al.
6,402,062 B1 * 6/2002 Bendig ..... B21B 45/08 239/589
6,431,466 B1 8/2002 Kitajima
6,435,426 B1 8/2002 Copp, Jr.
6,442,276 B1 8/2002 Doljack
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
7,533,678 B2 5/2009 Rosa
7,540,434 B2 6/2009 Gohring et al.
7,542,032 B2 6/2009 Kruse

(56) References Cited

U.S. PATENT DOCUMENTS 7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.
7,694,896 B2 4/2010 Turnbull et al.
D615,586 S 5/2010 Kudimi
D616,022 S 5/2010 Kudimi
D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
D655,347 S 3/2012 Gehrung
8,127,963 B2 3/2012 Gerson et al.
D657,276 S 4/2012 Brose
D661,742 S 6/2012 Clark
D663,960 S 7/2012 Jeronimo
8,225,892 B2 7/2012 Ben-Tzvi
8,240,579 B1 8/2012 Bennett
8,297,536 B2 10/2012 Ruda
D670,085 S 11/2012 Brookman et al.
D671,988 S 12/2012 Leipold
D672,012 S 12/2012 Brose
D674,880 S 1/2013 Schmon
8,352,744 B2 1/2013 Kruse
D681,162 S 4/2013 Kruse
8,444,067 B2 5/2013 Schmon et al.
8,454,759 B2 6/2013 Selsvik
8,481,124 B2 7/2013 Nolte et al.
D689,590 S 9/2013 Brose
D689,593 S 9/2013 Schmon
D690,799 S 10/2013 Maier
D692,530 S 10/2013 Gehrung
D692,532 S 10/2013 Li et al.
8,616,434 B2 12/2013 Wilen
D698,008 S 1/2014 Schmon et al.
8,626,674 B2 1/2014 Whitehouse
8,642,131 B2 2/2014 Nolte et al.
D704,300 S 5/2014 Li et al.
8,757,182 B2 6/2014 Schmon
8,807,460 B2 * 8/2014 Charpie et al. ..... 239/526
8,857,732 B2 10/2014 Brose
D720,015 S 12/2014 Kruse
8,899,501 B2 12/2014 Fox et al.
D721,785 S 1/2015 Gehrung
8,925,836 B2 1/2015 Dettlaff
D733,369 S 6/2015 Tschan
D733,453 S 7/2015 Tschan
D734,571 S 7/2015 Tschan
9,073,068 B2 7/2015 Krayer et al.
D737,126 S 8/2015 Tschan
D740,393 S 10/2015 Gehrung
D757,216 S 5/2016 Gehrung
D758,537 S 6/2016 Gehrung
2001/0004996 A1 6/2001 Schmon
2001/0040192 A1 11/2001 Kaneko et al.
2002/0134861 A1 9/2002 Petrie et al.
2002/0148501 A1 10/2002 Shieh
2002/0170978 A1 11/2002 Mohn
2003/0025000 A1 2/2003 Schmon et al.
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0177979 A1 9/2003 Crum et al.
2003/0189105 A1 10/2003 Schmon
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Santa Cruz et al.
2004/0050432 A1 3/2004 Breda
2004/0104194 A1 6/2004 Dennison
2004/0129738 A1 7/2004 Stukas
2004/0140373 A1 7/2004 Joseph et al.
2004/0155063 A1 8/2004 Hofeldt
2004/0177890 A1 9/2004 Weinmann
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0056613 A1 3/2005 King
2005/0082249 A1 4/2005 King
2005/0127201 A1 6/2005 Matsumoto
2005/0145723 A1 * 7/2005 Blette et al. ..... 239/525
2005/0145724 A1 7/2005 Blette et al.
2005/0178854 A1 8/2005 Dodd
2005/0220943 A1 10/2005 Abrams et al.
2005/0248148 A1 11/2005 Schenck et al.
2005/0252993 A1 11/2005 Rogers
2005/0252994 A1 11/2005 Rogers
2005/0268949 A1 12/2005 Rosa
2005/0284963 A1 12/2005 Reedy
2006/0000927 A1 1/2006 Ruda
2006/0007123 A1 1/2006 Wilson et al.
2006/0048803 A1 3/2006 Jessup et al.
2006/0081060 A1 4/2006 Forster
2006/0113409 A1 6/2006 Camilleri et al.
2006/0171771 A1 8/2006 Kruse
2006/0192377 A1 8/2006 Bauer et al.
2006/0196891 A1 9/2006 Gerson et al.
2007/0029788 A1 2/2007 Adler
2007/0055883 A1 3/2007 Kruse
2007/0131795 A1 6/2007 Abbate et al.
2007/0158349 A1 7/2007 Schmon et al.
2007/0205305 A1 9/2007 Vagedes
2007/0221754 A1 9/2007 Gehrung
2007/0252378 A1 11/2007 Chambers
2008/0011879 A1 1/2008 Gerson et al.
2008/0019789 A1 1/2008 Dunaway et al.
2008/0029619 A1 2/2008 Gohring et al.
2008/0128533 A1 6/2008 Gehrung
2008/0179763 A1 7/2008 Schmon et al.
2008/0251977 A1 10/2008 Naruse et al.
2008/0264892 A1 10/2008 Nozawa
2008/0272213 A1 11/2008 Ting
2008/0296410 A1 12/2008 Carey et al.
2009/0014557 A1 1/2009 Schmon et al.
2009/0026290 A1 1/2009 Fox
2009/0045623 A1 2/2009 Schmon
2009/0072050 A1 3/2009 Ruda
2009/0078789 A1 3/2009 Kruse
2009/0078790 A1 3/2009 Camilleri et al.
2009/0143745 A1 6/2009 Langan et al.
2009/0183516 A1 7/2009 Appler et al.
2009/0235864 A1 9/2009 Khoury et al.
2009/0266915 A1 10/2009 Fedorov
2010/0021646 A1 1/2010 Nolte et al.
2010/0059533 A1 3/2010 Unger et al.
2010/0084493 A1 4/2010 Troudt
2010/0108783 A1 5/2010 Joseph et al.
2010/0126541 A1 5/2010 Schmon
2010/0206963 A1 8/2010 Huang

(56) References Cited

U.S. PATENT DOCUMENTS

| | | | |
|---|---|---|---|
| 2011/0024524 | A1 | 2/2011 | Fox |
| 2011/0121103 | A1 | 5/2011 | Carleton et al. |
| 2011/0125607 | A1 | 5/2011 | Wilen |
| 2011/0127767 | A1 | 6/2011 | Wicks et al. |
| 2011/0168811 | A1 | 7/2011 | Fox et al. |
| 2011/0174901 | A1 | 7/2011 | Dettlaff et al. |
| 2012/0012671 | A1 | 1/2012 | Brose et al. |
| 2012/0097762 | A1 | 4/2012 | Gehrung et al. |
| 2012/0132550 | A1 | 5/2012 | Gerson et al. |
| 2012/0160935 | A1 | 6/2012 | Krayer et al. |
| 2013/0056556 | A1 | 3/2013 | Schmon et al. |
| 2013/0074864 | A1 | 3/2013 | Nuzzo et al. |
| 2013/0266734 | A1 | 10/2013 | Nolte et al. |
| 2013/0320110 | A1 | 12/2013 | Brose et al. |
| 2014/0048627 | A1 | 2/2014 | Schmon et al. |
| 2014/0059905 | A1 | 3/2014 | Raming |
| 2014/0145003 | A1 | 5/2014 | Schmon et al. |
| 2014/0305962 | A1 | 10/2014 | Tschan |
| 2015/0165463 | A1 | 6/2015 | Gehrung |
| 2016/0030960 | A1 | 2/2016 | Gehrung |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CH | 203 668 | | 6/1939 |
| CH | 542104 | A | 9/1973 |
| CH | 676208 | | 12/1990 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| DE | 460381 | | 5/1928 |
| DE | 510362 | | 10/1930 |
| DE | 1425890 | | 11/1968 |
| DE | 2559036 | | 9/1976 |
| DE | 2653981 | | 6/1978 |
| DE | 2950341 | | 7/1980 |
| DE | 3016419 | | 11/1981 |
| DE | 8024829.9 | | 9/1982 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265.8 | U1 | 4/1990 |
| DE | G 90 01 265 | | 5/1990 |
| DE | 3906219 | | 8/1990 |
| DE | 4302911 | | 8/1993 |
| DE | 4230535 | | 3/1994 |
| DE | 1321940 | | 1/1995 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 03069208 | A1 | 8/2003 |
| DE | 10205831 | | 8/2003 |
| DE | 10311238 | | 10/2004 |
| DE | 10 2004 027 789 | | 2/2005 |
| DE | 10 2004 027789 | | 2/2005 |
| DE | 29825120 | | 2/2005 |
| DE | 2004027789 | A1 | 2/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 021 298 | | 11/2005 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007039106 | | 2/2009 |
| DE | 102007052067 | | 5/2009 |
| DE | 202010012449 | | 12/2010 |
| DE | 102009053449 | | 2/2011 |
| DE | 102010060086 | | 4/2012 |
| DE | 102011106060 | | 1/2013 |
| DE | 102011118120 | | 5/2013 |
| EP | 0092392 | | 10/1983 |
| EP | 524408 | | 1/1993 |
| EP | 567325 | | 10/1993 |
| EP | 0631821 | | 1/1995 |
| EP | 0650766 | | 5/1995 |
| EP | 678334 | | 10/1995 |
| EP | 0706832 | | 4/1996 |
| EP | 0710506 | | 5/1996 |
| EP | 801002 | | 10/1997 |
| EP | 987060 | | 3/2000 |
| EP | 1081639 | | 3/2001 |
| EP | 1106262 | | 6/2001 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |

(56) References Cited

FOREIGN PATENT DOCUMENTS

| | | | | |
|---|---|---|---|---|
| EP | 1708822 | | 10/2006 | |
| EP | 1708823 | | 10/2006 | |
| EP | 1718415 | | 11/2006 | |
| EP | 1880771 | A1 | 1/2008 | |
| EP | 1902766 | A1 | 3/2008 | |
| EP | 1902786 | | 3/2008 | |
| EP | 1902876 | | 3/2008 | |
| EP | 1930084 | | 6/2008 | |
| EP | 1964616 | | 9/2008 | |
| EP | 1964616 | A2 | 9/2008 | |
| EP | 2027931 | | 2/2009 | |
| EP | 2106298 | | 10/2009 | |
| EP | 2111920 | | 10/2009 | |
| EP | 2490819 | | 8/2012 | |
| EP | 2576079 | | 4/2013 | |
| EP | 2608890 | | 7/2013 | |
| FR | 398333 | | 6/1909 | |
| FR | 789762 | | 11/1935 | |
| FR | 1410519 | | 9/1964 | |
| FR | 2444501 | | 7/1980 | |
| FR | 2462200 | A1 | 2/1981 | |
| FR | 2 570 140 | | 3/1986 | |
| FR | 2 774 928 | | 8/1999 | |
| FR | 2927824 | A1 | 8/2009 | |
| GB | 190900523 | | 6/1909 | |
| GB | 2063713 | A * | 6/1981 | ..... B05B 7/1209 |
| GB | 2 132 916 | | 7/1984 | |
| GB | 2153260 | | 8/1985 | |
| GB | 2372465 | | 8/2002 | |
| GB | 2411235 | | 8/2005 | |
| HK | 1100405 | | 6/2009 | |
| HK | 1096057 | | 7/2009 | |
| HK | 1125067 | | 8/2012 | |
| HK | 1138533 | | 11/2012 | |
| JP | S5654328 | | 5/1981 | |
| JP | S57-75246 | | 5/1982 | |
| JP | 58-119862 | | 5/1983 | |
| JP | S5998757 | | 6/1984 | |
| JP | S601722 | | 1/1985 | |
| JP | H01-87805 | | 6/1989 | |
| JP | H0530749 | | 4/1993 | |
| JP | H05172678 | | 7/1993 | |
| JP | 674850 | | 3/1994 | |
| JP | H06215741 | | 8/1994 | |
| JP | 108196950 | | 8/1996 | |
| JP | H09117697 | | 5/1997 | |
| JP | 2001259487 | | 9/2001 | |
| JP | 2003042882 | | 2/2002 | |
| JP | 2003088780 | | 3/2003 | |
| JP | 2004017044 | | 1/2004 | |
| JP | 2005138885 | | 6/2005 | |
| JP | 2007516831 | | 6/2007 | |
| TW | 491092 | | 6/2002 | |
| TW | 1220392 | | 8/2004 | |
| TW | 1303587 | | 12/2008 | |
| TW | 1309584 | | 5/2009 | |
| WO | 90/08456 | | 8/1990 | |
| WO | 91/16610 | | 10/1991 | |
| WO | 92/07346 | | 4/1992 | |
| WO | 9522409 | | 8/1995 | |
| WO | 98/32539 | | 7/1998 | |
| WO | 01/12337 | | 2/2001 | |
| WO | 01/012337 | | 2/2001 | |
| WO | 0166261 | | 9/2001 | |
| WO | 01/099062 | | 12/2001 | |
| WO | 02/000355 | | 1/2002 | |
| WO | 0202242 | | 1/2002 | |
| WO | 02/018061 | | 3/2002 | |
| WO | 02/085533 | | 10/2002 | |
| WO | 03/007252 | | 1/2003 | |
| WO | 03/045575 | | 6/2003 | |
| WO | 03/069208 | | 8/2003 | |
| WO | 2004/037433 | | 5/2004 | |
| WO | 2004/37433 | | 5/2004 | |
| WO | 2004/052552 | | 6/2004 | |
| WO | 2005/018815 | | 3/2005 | |
| WO | 2005/068220 | | 7/2005 | |
| WO | 2005/070557 | | 8/2005 | |
| WO | 2005/070558 | | 8/2005 | |
| WO | 2005/077543 | | 8/2005 | |
| WO | 2005/115631 | | 12/2005 | |
| WO | 2006065850 | | 6/2006 | |
| WO | 2007/128127 | | 11/2007 | |
| WO | 2007133386 | A2 | 11/2007 | |
| WO | 2007/149760 | A2 | 12/2007 | |
| WO | 2009015260 | | 1/2009 | |
| WO | 2009056424 | | 5/2009 | |
| WO | 2011047876 | | 4/2011 | |
| WO | 2011147555 | | 12/2011 | |
| WO | 2012119664 | | 9/2012 | |
| WO | 2013000524 | | 1/2013 | |
| WO | 2013016474 | | 1/2013 | |

OTHER PUBLICATIONS

International Search Report dated Sep. 21, 2011 for PCT/EP2011/002544.

Canadian Office Action dated Nov. 21, 2012 for related application CA2741703.

Chinese Search Report dated Dec. 5, 2012 for related application CN200980135429.9.

Chinese Office Action dated Dec. 13, 2012 for related application CN200980135429.9.

German Search Report for DE 20 2008 014 389.6 dated Jul. 13, 2009.

Office Action dated Nov. 18, 2014 for U.S. Appl. No. 14/113,649.

Notice of Allowance dated Nov. 19, 2014 for U.S. Appl. No. 29/486,223.

Office Action dated Dec. 31, 2014 for U.S. Appl. No. 13/380,949.

Restriction Requirement dated Jan. 9, 2015 for U.S. Appl. No. 29/469,049.

Response to Office Action filed Dec. 2, 2014 for U.S. Appl. No. 29/487,679.

Notice of Allowance dated Jan. 15, 2015 for U.S. Appl. No. 29/490,620.

Office Action dated Jan. 14, 2015 for U.S. Appl. No. 29/447,887.

Hercules Paint Gun Washers brochure publish date Jan. 2012, [online], [site visited Jan. 7, 2015], <http://www.herkules.us/pdfs/L00761-Hercules-Gun_Washers-4-page-brochure.pdf>.

Jetclean GUn Cleaner Terry's Auto Supply, google publish date Aug. 14, 2011, [online], [site visited Jan. 7, 2015], <http://secure.terrys.net/viewProduct.php?productID=FT.FHAZ1005>.

Restriction Requirement dated Feb. 6, 2015 for U.S. Appl. No. 29/486,232.

Final Office Action dated Jul. 20, 2015 for U.S. Appl. No. 14/113,649.

Responde to Office Action filed Apr. 14, 2015 to Office Action dated Jan. 14, 2015 for U.S. Appl. No. 29/447,887.

Application filed Jan. 29, 2015 for U.S. Appl. No. 29/516,073.

Notice of Allowance dated Apr. 30, 2015 for U.S. Appl. No. 29/447,887.

Chinese Office Action dated Oct. 28, 2014 and Search Report dated Oct. 15, 2014 for Chinese Application No. 2011800266029.

Australian Examination Report dated Oct. 30, 2012 for Australian Application No. 2010268870.

Notice of Allowance dated Apr. 24, 2015 for U.S. Appl. No. 29/486,232.

Restriction Requirement dated May 27, 2015 for U.S. Appl. No. 13/991,285.

Application filed Jan. 29, 2015 for U.S. Appl. No. 29/516,082.

Response filed Apr. 6, 2015 to Office Action dated Feb. 6, 2015 for U.S. Appl. No. 29/486,232.

Response filed Mar. 31, 2015 to Office Action dated Dec. 31, 2014 for U.S. Appl. No. 13/380,949.

Japanese Office Action dated Jun. 11, 2014 for Japanese Patent Application No. 2012-518769.

Australian Examination Report dated Nov. 11, 2014 for Australian patent Application No. 2011257605.

(56) References Cited

OTHER PUBLICATIONS

Japanese Notice of Allowance mailed Jan. 13, 2015 for Japanese Patent Application No. 20121518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Application filed Mar. 3, 2015, 2015 for U.S. Appl. No. 29/519,198.
Application filed Jun. 2, 2013 for U.S. Appl. No. 13/991,285.
English translation of application filed Aug. 13, 2013 for Application filed Jun. 2, 2013 for U.S. Appl. No. 13/991,285.
International Search Report, Written Opinion and International Preliminary Report on Patentability for PCT/EP2004/005381 filed May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sept 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sept 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued agains JP Patent App. 2012-508926 on Feb. 25, 2014 with English translation.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.califomiasteel.com/GetPublicFile.aspx?id=53.
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
Office Action dated Aug. 7, 2015 for U.S. Appl. No. 13/991,285.
International Search Report (dated Jun. 20, 2008), Written Opinion (dated Jun. 20, 2008), and International Preliminary Report on Patentability (dated Sept 14, 2010) from PCT/US2008/03318 filed Mar. 12, 2008.
Response filed Dec. 7, 2015 to Office Action dated Aug. 7, 2015 for U.S. Appl. No. 13/991,285 (36).
Notice of Allowance dated Jan. 27, 2016 for U.S. Appl. No. 29/510,723.
Extended European Search Report dated Apr. 17, 2015 for European Application No. 14004167.4 (87).
Response filed Dec. 21, 2015 to Office Action dated Jul. 20, 2015 for U.S. Appl. No. 14/113,649.
Office Action dated Dec. 31, 2015 for U.S. Appl. No. 14/572,998.
Notice of Allowance dated Jan. 19, 2016 for U.S. Appl. No. 29/539,615.
Notice of Allowance dated Jan. 22, 2016 for U.S. Appl. No. 13/991,285.
Office Action dated Feb. 19, 2016 for U.S. Appl. No. 14/113,649.
Second Chinese Office Action dated Jun. 24, 2015 for Chinese Application No. 2011800266029.
Third Chinese Office Action dated Nov. 30, 2015 for Chinese Application No. 2011800266029.
Response filed Mar. 31, 2016 to Office Action dated Dec. 31, 2016 for U.S. Appl. No. 14/572,998.
Restriction Requirement dated Mar. 25, 2016 for U.S. Appl. No. 29/516,082.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
Printout from Internet www.ehow.com explaining how to choose a spray gun and stating in item 2 "Nozzle sizes vary between about 1 mm and 2 mm.", printed Sep. 7, 2012.
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012.
Printout from Internet of pages from brochure of Walther Pilot showing nozzle sizes for spray guns ranging from 0.3 mm to 2.5 mm, dated 2007.
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012.
Printout from Internet of p. 28 from current 3Mtm brochure showing Tip/Nozzle/Air Cap Selection Guide with nozzle sizes from 0.5 mm to 3.0 mm.
Decision by EPO regarding opposition proceedings to revoke patent No. 99926841.0-2425/ 1108476, corresponding to '387 patent, 2012.
SATA News Publication Dan-Am Jul.-Sep. 1996.
SATA News Publication Dan-Am Oct.-Dec. 1996.
SATA News Publication Dan-Am Apr.-Jun. 1998.
Dan-Am SATA Catalog 6 for spray guns 1991.
Dan-Am SATA Catalog 8 for spray guns 1994.
Dan-Am Catalog 6-51pp published 1991.
Japanese Industrial Standards B 9809 English translation, 1992.
Japanese Industrial Standards B 9809 revised Mar. 1, 1991.
SATA News, vol. 21, 2009.
Collision Hub TV Document (image from video clip) printed Oct. 9, 2013.
MyRielsMe.com document from press release printed Oct. 9, 2013.
How to set Air pressure, Utube screenshot printed Oct. 9, 2013.
Ohio EPA Lefty to Tony Larimer, response to letter dated Aug. 2006.
Pinahs Ben-Tzvi et al, A conceptual design . . . , Mechatrronics 17 (2007) p. 1-13.

(56) References Cited

OTHER PUBLICATIONS

On line ad from Amazon.com printed Oct. 14, 2013.
Rone et al, MEMS-Baed Microdroplet Generation with Integrated Sensing, COMSOL, 2011.
Response restriction requirement filed May 23, 2015 for U.S. Appl. No. 29/516,082.

* cited by examiner

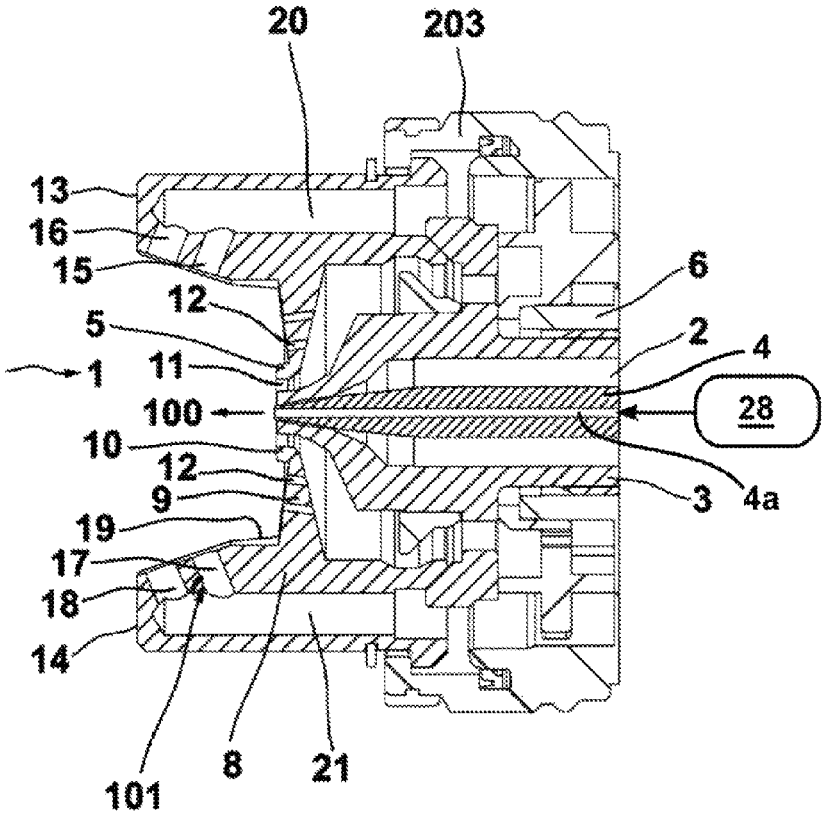
FIG. 16
FIG. 17
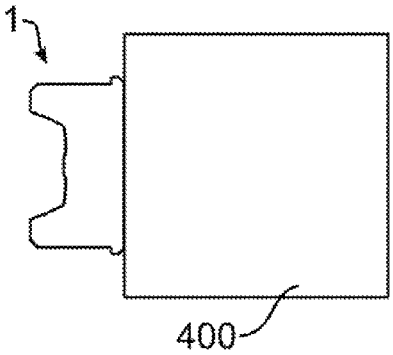
FIG. 18
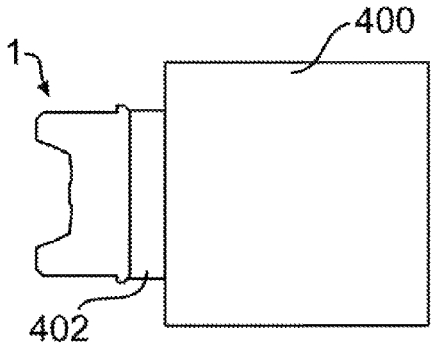

NOZZLE HEAD FOR A SPRAY DEVICE

FIELD OF THE INVENTION

The invention pertains to a nozzle head for a spray device.

BACKGROUND OF THE INVENTION

Such nozzle heads are commonly used on spray devices for the hydrostatic, pneumatic or combined hydrostatic and pneumatic atomization of paints, varnishes, adhesives or other liquid substances, particularly in paint spray guns.

In the nozzle heads of such spray devices, the air ring nozzle has the function of discharging the compressed air supplied to the device in the form of a high-energy air jet that draws material from another central nozzle, atomizes this material and forms a spray jet containing said material. Horn air nozzles usually are directed at the spray jet obliquely and equidirectionally to the outflow direction in laterally arranged horns of the nozzle head that point forward in the spray jet direction such that the air jets being discharged from these nozzles can respectively deform or form the spray jet. Due to the lateral deformation/formation, a more or less large flat jet or flat jet and round jet is created in dependence on the flow energy (air quantity, air pressure, flow speed, etc.).

In order to achieve an optimal work result, the spray jet needs to be adapted, among other things, with respect to the jet width, the material distribution, the material type and the droplet size. The adaptation is essentially carried out in dependence on the physical boundary conditions (supply air pressure, air quantity, etc.) in the form of a constructive adaptation of the openings of the central air ring nozzle and the horn air nozzles. In order to achieve sufficiently homogenous spray jets, one, two, three or more horn air nozzles that interact with the central opening of the central nozzle are typically used per horn. Paint spray guns with one, two or more horn air nozzles are known from practical applications and ensure a sufficient jet formation and atomization based on the criteria mutual distance, diameter, angle and distance from the paint nozzle opening, as well as the number thereof. In this case, the horn air nozzles are arranged in an air cap that is mounted on the paint spray gun body, usually screwed thereon by means of mounting rings. The central air nozzle may also be directly screwed, clipped or similarly mounted on the paint nozzle or on the paint spray gun body. A nozzle head of this type is known, for example, from German Utility Model G 90 01 265.8. The paint nozzle openings and the horn air nozzle openings are conventionally realized in the form of round bores.

In practical applications, the diameters of the horn air nozzles are realized differently depending on the supply pressure and the individually desired shape of the spray jet. The effect of the individual horn air nozzles is dependent on the supply pressure. Splitting of the jet may occur at higher supply pressures. An undesirably coarse atomization with small jet width may occur at excessively low supply pressures. In addition, the material throughput and other material properties (e.g., viscosity, rheology, etc.) are also highly dependent on the supply pressure and the arrangement of the horn air nozzles. When using one or more smaller horn air nozzles or unfavorable bore angles, back-misting problems may occasionally arise on the opening surfaces of the nozzles due to the suction effect occurring at smaller nozzle or bore diameters.

Small control openings or auxiliary atomizer openings that contribute to the jet formation and the atomization are usually arranged around the central nozzle. In order to transform the pre-formed jet emerging from the cylindrical tube of the central air nozzle opening into a different shape or, for example, to convert a round jet into a flat jet, large amounts of energy from the jet formation bores and the horn bores are required, which ultimately lead to high energy losses and limit the jet formation.

One significant disadvantage of this jet formation method can be seen in that a large part of the energy for the jet formation and the post-atomization is already blown out into the surrounding air through the narrow bores and multiple outlets (large shear planes on the surface in connection with significant fluctuations in speed).

Modified nozzle heads with possibly deviating spraying parameters and geometries frequently need to be used for slightly different paint or varnish materials in order to achieve a flawless spray pattern and therefore the desired result of the paint application, varnish application or other material application.

SUMMARY OF THE INVENTION

It is the objective of the invention to improve a nozzle head in such a way that the flow energy of the compressed air can be optimally converted into jet formation, flow speed and therefore into atomization work.

This objective is attained with a nozzle head in accordance with the present disclosure. Due to the formation of the central jet with the aid of at least one non-cylindrical nozzle, particularly at least one non-cylindrical horn air nozzle, it is also possible to significantly reduce the amount of energy required for the jet formation.

The invention is based on the fact that the required adaptation of cylindrical nozzles to the individual requirements can only be realized by varying the diameter sizes, the length and the inclination of the cylindrical bores, their mutual distance and the distance from the other nozzle openings. Non-cylindrical nozzles can be fluidically optimized and adapted to the individual task in an easier fashion.

It goes without saying that the internal shape, particularly the opening of the nozzles, should be non-cylindrical in this case. The external shape of the nozzles usually is unimportant for the jet formation.

Advantageous embodiments of the invention are disclosed in the remaining claims.

In an enhancement of the invention, a variable design of the control bores is proposed in order to achieve an efficient jet formation.

This applies analogously to the shaping of the flow regions of the air nozzle. Consequently, the round jet can be pre-formed due to a special shaping in such a way that less horn air is required for the formation of the broad jet and arbitrary jet shapes can be realized.

It is proposed, in particular, to utilize nozzles with an elliptical or at least approximately oblong hole-shaped cross section.

The atomization process can be additionally improved with a nozzle opening that widens in the direction of the spray jet.

It is also possible to provide grooves, lamellae, air guide vanes or the like in order to guide the air in the nozzle openings.

The non-cylindrical nozzles may be produced in metallic parts by means of machining. The non-cylindrical nozzles can be manufactured in a particularly simple fashion from plastic, particularly from a plastic that can be injection-molded. Such nozzles may likewise be realized in plastic inserts and mounted in nozzle heads of metal.

In addition, other advantageous effects can be achieved due to the combination of cylindrical, conical and other non-cylindrical nozzle openings.

BRIEF DESCRIPTION OF THE DRAWINGS

Other advantageous details and embodiments of the invention are illustrated in the figures described below.

In these figures:

FIG. 16 shows the section of FIG. 1, the air ring nozzle realized in one piece with a portion of the spray device;

FIG. 17 shows a nozzle head of the disclosure attached to a body of a spray device; and FIG. 18 shows a nozzle head of the disclosure connected to a separate device which is attached to a body of a spray device.

DETAILED DESCRIPTION OF THE INVENTION

Figure 1:
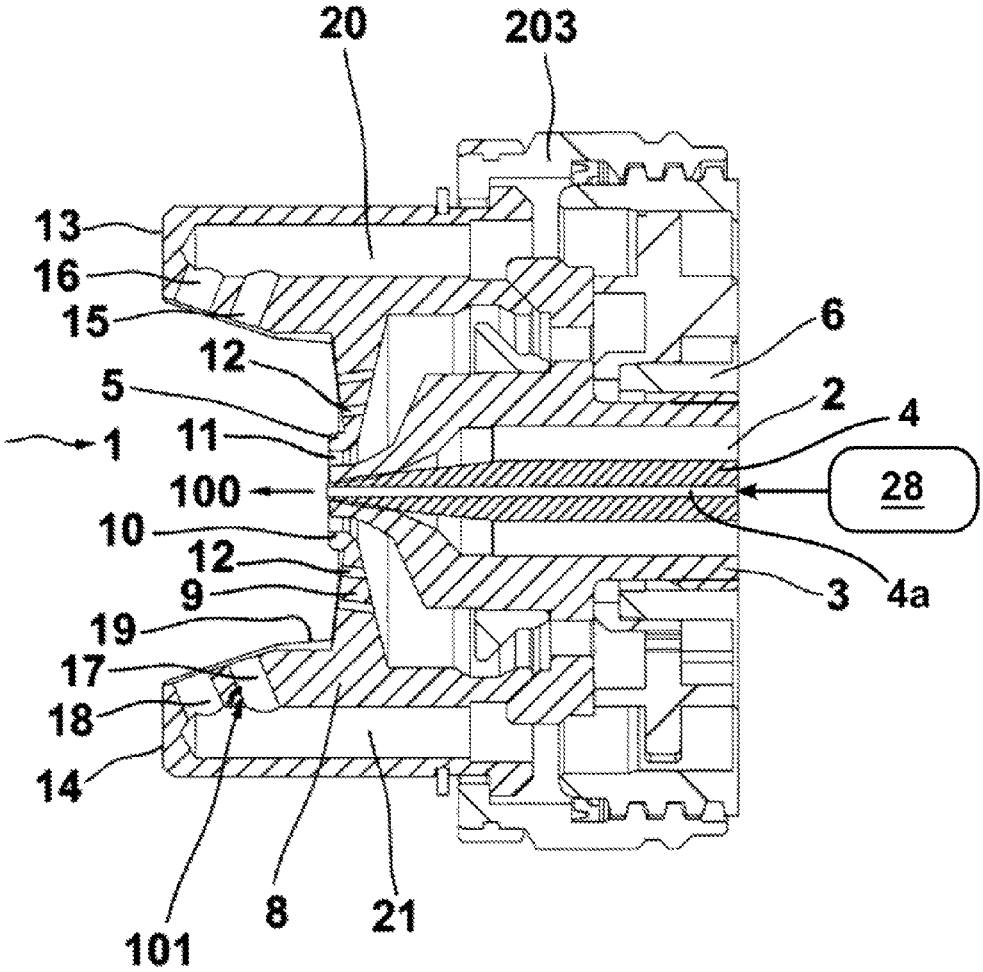
FIG. 1 shows a section through a first exemplary embodiment of a nozzle head.
Figure 2:
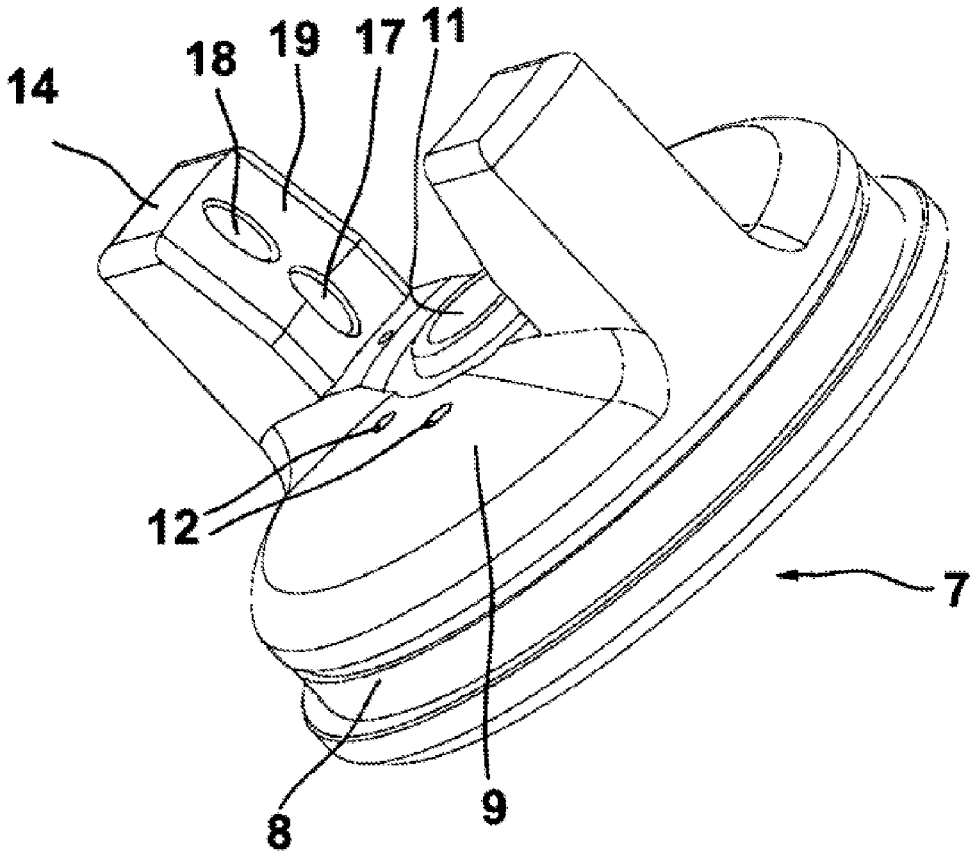
FIG. 2 shows a top view of a portion of the nozzle head according to FIG. 1.

The nozzle head for a paint spray gun illustrated in FIGS. 1 and 2 features a paint nozzle body 1 with an essentially cylindrical paint channel 2 that centrally opens into a paint nozzle 3. A hollow paint needle 4 is inserted into the paint nozzle 3. The paint nozzle 3 is surrounded by an air ring nozzle 5, to which air can be supplied via channels 6. An air cap 7 is screwed on the gun body by means of a ring 203 that is usually referred to as [an] air nozzle ring. However, the air cap 7 could also be mounted on the gun body in a different way. In the present exemplary embodiment, the air cap 7 is injection-molded of plastic. It features an annular section 8 that suitably adjoins the gun body. This annular section 8 is followed by an essentially plane cover plate 9. In a so-called opening area, the cover plate 9 features an annular elevation 10 that protrudes over this plane area 9 and into which an opening 11 is centrally recessed. When the paint nozzle 3 is installed, the opening 11 extends around this paint nozzle and therefore around the air ring nozzle 5. Continuous control nozzles or control openings 12 are provided at several locations in the cover plate 9 laterally of the opening 11. The control nozzle openings 12 are aligned at an angle of approximately 20 degrees referred to the spray jet direction 100. At two opposite locations, the air cap 7 respectively features a horn 13 or 14 that extends forward in the spray jet direction 100. In the present exemplary embodiment, the horns 13, 14 are respectively realized in the form of a body of rectangular cross section that is closed on the top. Each horn 13, 14 respectively features two horn air nozzles 15, 16 and 17, 18 that are arranged behind one another in the spray jet direction 100 and extend through the inner wall 19 of the horns 13, 14. The horn air nozzles 15, 16, 17, 18 are obliquely aligned in the direction of the spray jet 100. In the present example, both horn air nozzles 15, 16 and 17, 18 of each horn 13 and 14 essentially extend parallel to one another at an angle 101 of approximately 140 degrees referred to the spray jet direction 100. However, the horn air nozzles 15, 16 may also be aligned at an angle relative to one another or against one another. They can be supplied with compressed air via one respective air channel 20 or 21 that extends through the respective horn 13 or 14 in the longitudinal direction. The high-energy annular air jet being discharged from the air ring nozzle 5 draws the paint from the paint nozzle 3, wherein a round jet is formed and discharged in the spray jet direction 100. The horn air jets being discharged from the horn air nozzles 15, 16 and 17, 18 are directed at the round jet, flow obliquely and equidirectionally to the spray jet direction 100 and deform the round jet into the desired broad jet.

The horn air nozzles 15, 16 and 17, 18 are fluidically optimized in such a way that the round jet is subjected to a homogenous jet formation and the desired jet width is achieved without splitting the spray jet. According to FIG. 2, both horn air nozzles 17, 18 of the horn 14 have an elliptical cross section and have the same size. In the present exemplary embodiment, the small curvatures of the ellipses respectively lie on the top and on the bottom. However, the ellipses could also be arranged transverse to the longitudinal direction of the respective horn 14 or 13. Combinations of such ellipses are also conceivable. This special design of the horn air nozzles 17, 18 could be realized without any problems by injection-molding the air cap 7. In this case, it is not absolutely imperative to provide a separate air cap 7; the nozzle head 1 could also be realized differently (in one piece). In the context of the invention, the non-cylindrical nozzles in the nozzle head are of essential importance.

In the present exemplary embodiment, the paint needle 4 is hollow and features an opening **4*a* that is realized cylindrically along its longitudinal axis and through which a vacuum or an overpressure can be generated in the spray jet. In one particular variant, another varnish component is injected into the spray jet via the hollow needle 4. For this purpose, the inlet opening of the needle 4 is connected to corresponding material-containing devices in a known manner, as represented by device 28 of FIG. 1. In a special embodiment, the opening 4*a*** may be realized non-cylindrically such as, e.g., with an oval cross section or with any other non-cylindrical shape.

The opening **4*a*** may be connected to compressed air or to a vacuum.

On the other hand, the paint needle 4 may also be realized in the form of a solid body rather than in a hollow fashion. In this case, the needle 4 advantageously is always realized such that its external shape corresponds to the internal shape of the paint nozzle 3 at the sealing point or contact surface with this nozzle and sealing pairings are realized.

Figure 3:
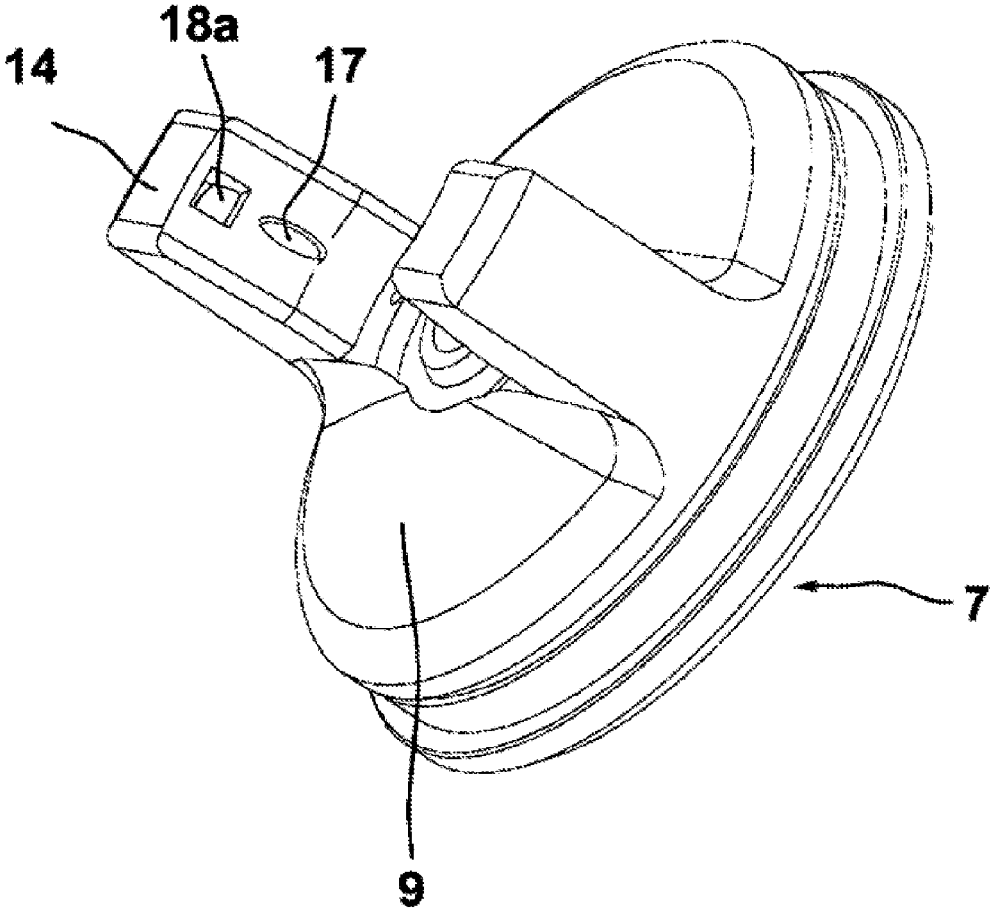
FIG. 3 shows a variant of FIG. 2, FIGS. 4-8 and 11-14 respectively show a top view of miscellaneous variants of a portion of a nozzle head, FIGS. 9 and 10 respectively show a sectional representation of a nozzle head.

In the variant according to FIG. 3, the first horn air nozzle 17 referred to the spray jet direction 100 is realized with an elliptical cross section while the next horn air nozzle **18*a* is realized with a square cross section. A rectangular shape would also be conceivable. The horn air nozzle 18*a* is smaller than the horn air nozzle 17** in this case. No control openings are provided in this exemplary embodiment. However, they could also be provided in this case. This also applies analogously to the embodiments described below.

Figure 4:
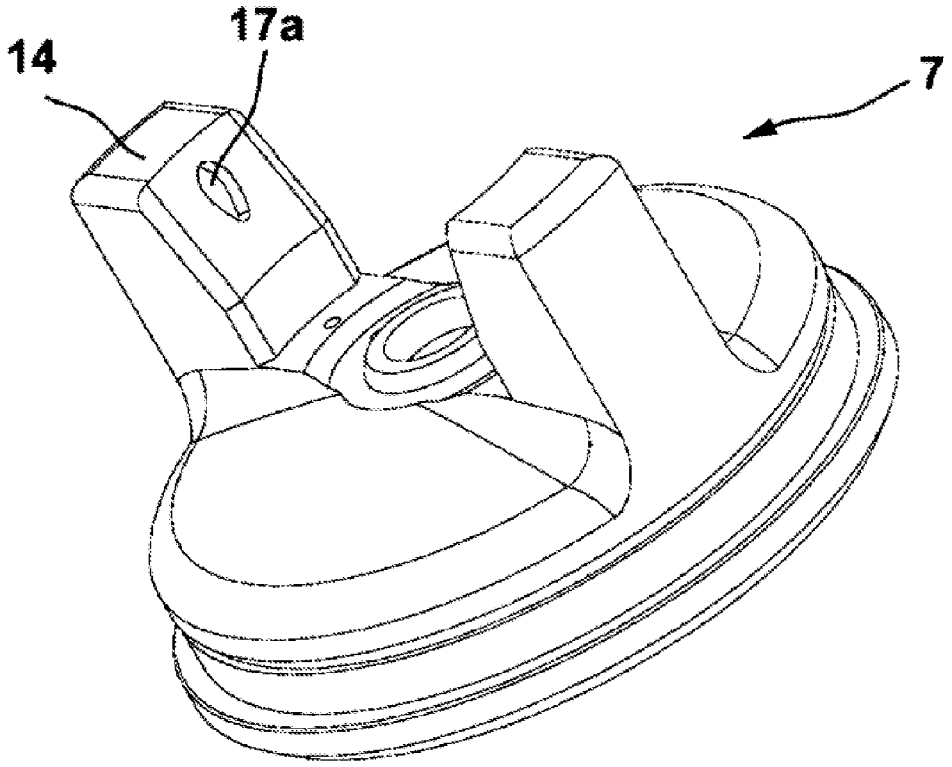

FIG. 4 shows an air cap 7 for a nozzle head, on which only a single horn air nozzle **17*a* is provided per horn. This horn air nozzle 17*a* is shaped in a drop-shaped oval fashion, wherein the greater curvature of the oval is arranged in the upper region of the horn 14 in a top view of the inner wall 19 of the horn 14**.

Figure 5:
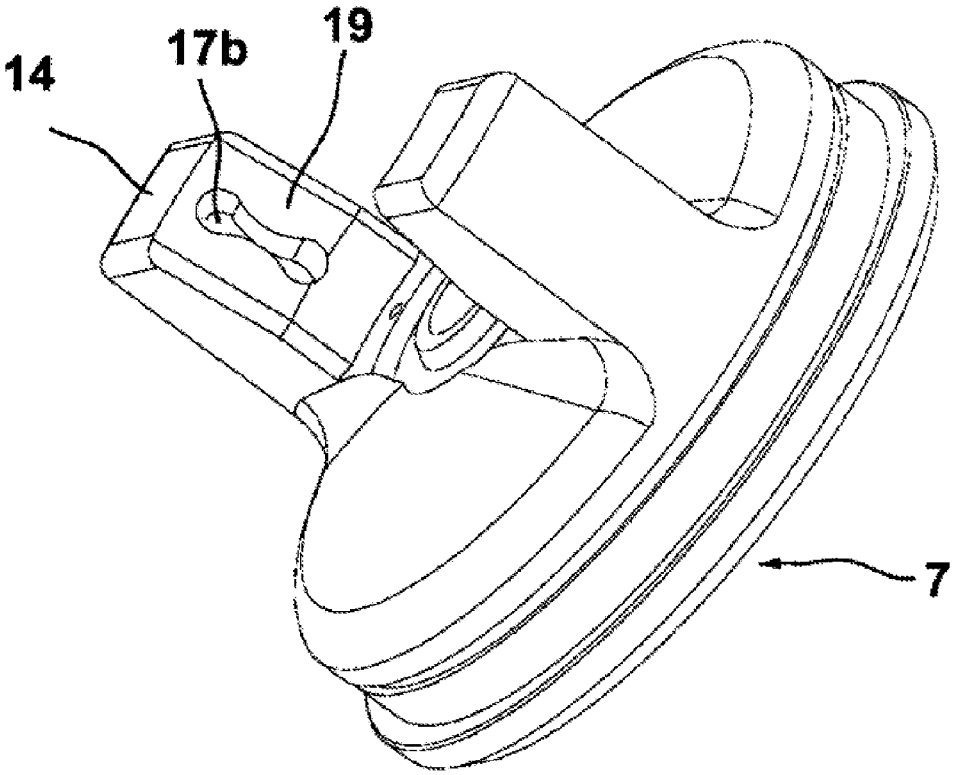

In the variant illustrated in FIG. 5, only a single horn air nozzle **17*b* is likewise provided per horn. In this case, the shape of the horn air nozzle 17***b* is realized in such a way that approximately the contour of the number 8 is visible in a top view of the inner wall 19 of the horn 14.

Figure 6:
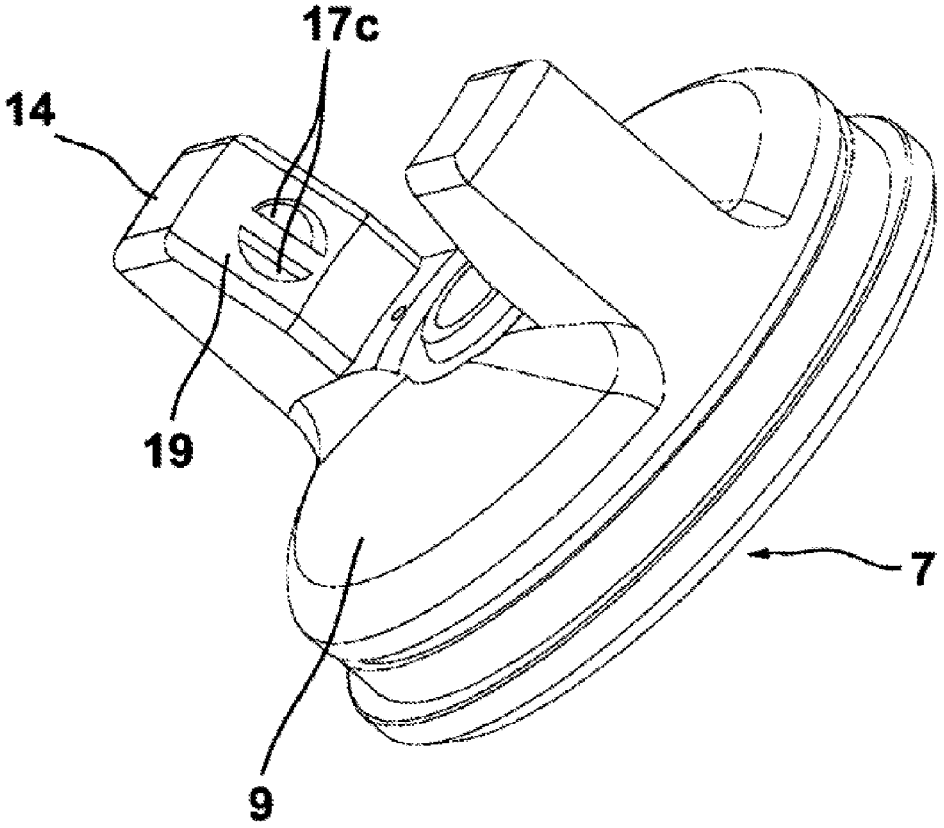

FIG. 6 shows a variant similar to that illustrated in FIG. 5. In the air cap 7, the horn air nozzle 17*b* according to FIG. 5 effectively is longitudinally divided into a two-part horn air nozzle 17*c* in this case. The two parts of the horn air nozzle 17*c* are realized in an approximately lunulate fashion. In the embodiment shown, the curvatures are directed outward. However, a reversed arrangement would likewise be conceivable. It is also possible to respectively align the curvatures of the crescents toward the top and the bottom.

Figure 6A:
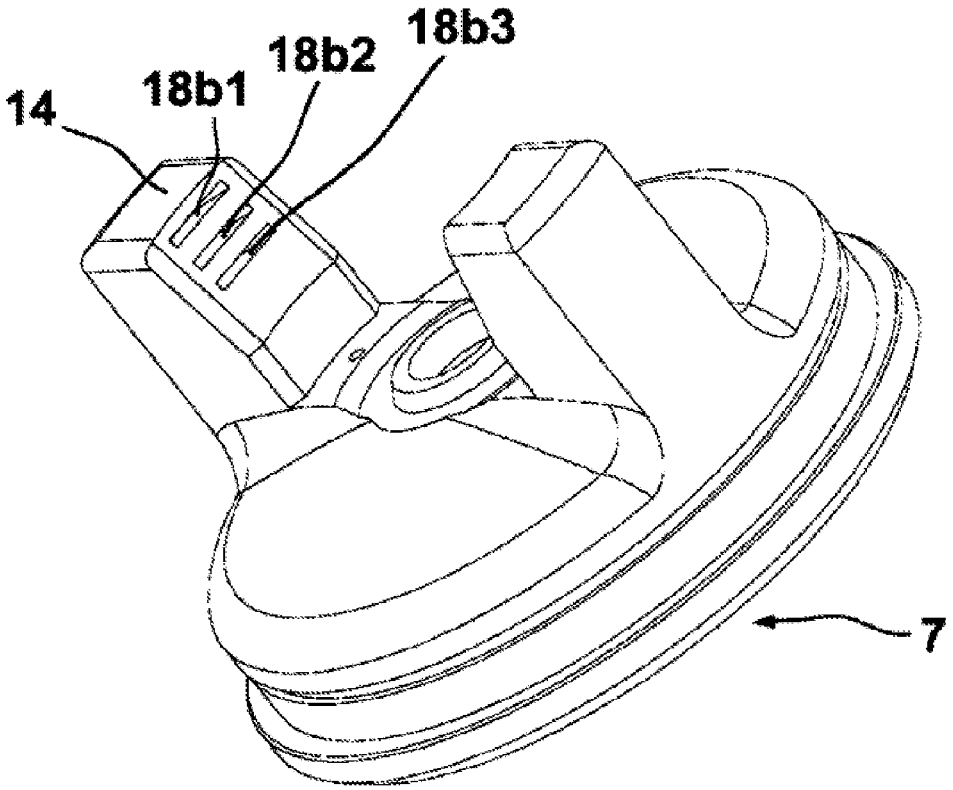

In the variant according to FIG. 6*a*, three horn air nozzles 18*b*1, 18*b*2, 18*b*3 of rectangular cross section are provided in the horn 14 of the air cap 7.

The horn air nozzles described so far have the same internal size anywhere in the longitudinal direction. However, it is also possible to utilize horn air nozzles that are widened or tapered in the longitudinal direction.

Figure 7:
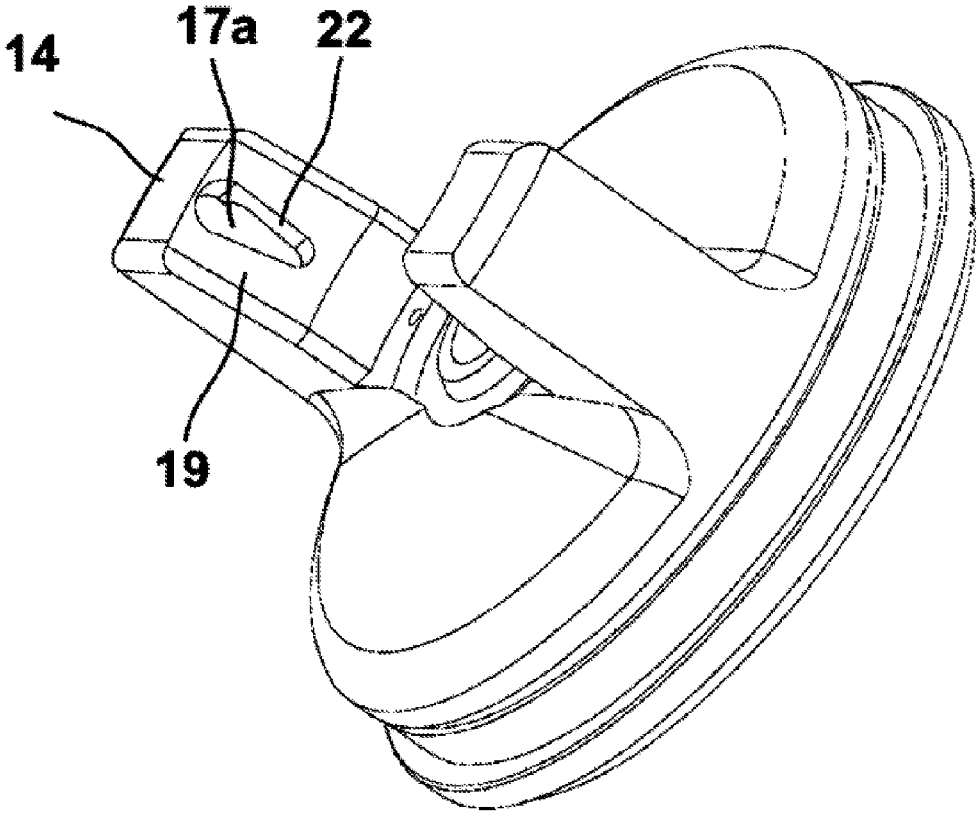

FIG. 7 shows a variant, in which the horn air nozzle 17*d* that has an elliptical shape in a top view respectively widens toward the top or in the longitudinal direction along its longitudinal extent through the inner wall 19 of the horn 14. In this case, the flow surface 22 of the horn air nozzle 17*d* is realized in a smooth fashion.

The flow surface 22 of the horn air nozzle 17*d* or another horn air nozzle could also have a corrugated, nubby, fluted or spiral-shaped design or be realized in a different way.

Figure 8:
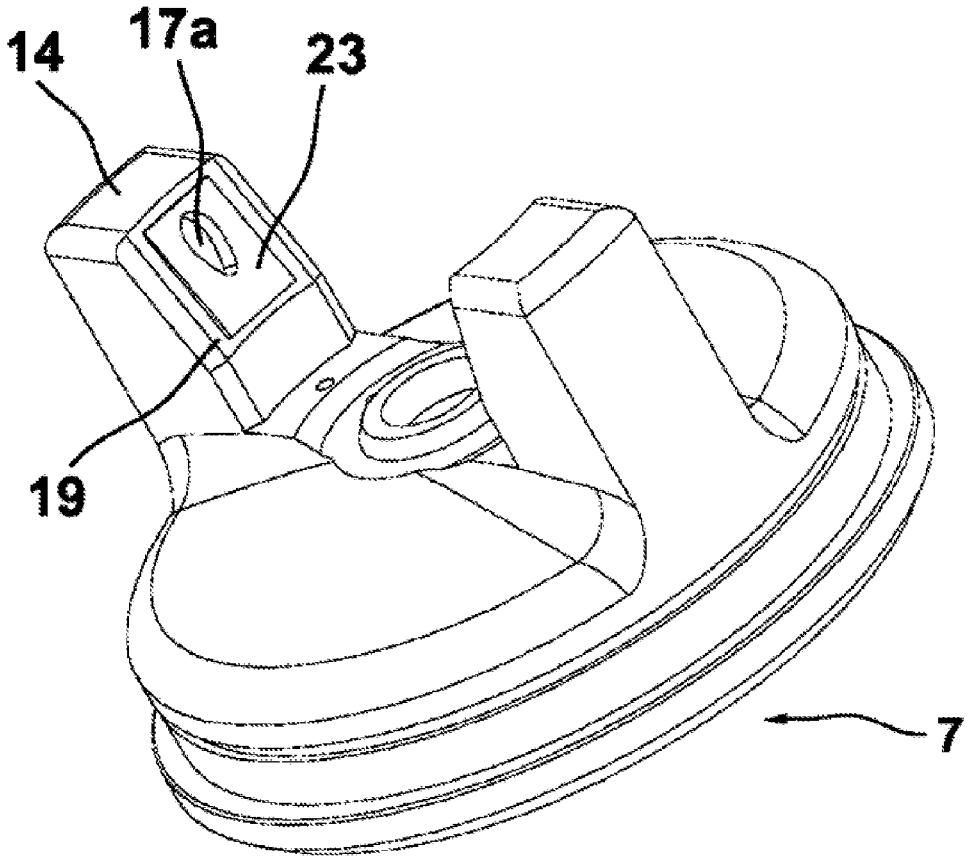

In the variant according to FIG. 8, the same horn air nozzle 17*a* as in FIG. 4 is provided on the air cap 7. However, the horn air nozzle 17*a* was not manufactured together with the air cap 7 in this case, but rather recessed from a plastic body 23 in the form of a continuous opening, wherein said plastic body is inserted, particularly clipped, into a continuous opening in the inner wall 19 of the horn 14 in a precisely fitted fashion. In the present example, the insert is realized with a rectangular contour—like the opening in the inner wall 19 of the horn 14. The insert and the opening for the horn air nozzle 17*a* or another horn air nozzle naturally may also be realized differently; these details are not particularly important for the function of the inventive nozzle head. Thusly shaped openings for accommodating nozzles not only can be produced without any problems on air caps of plastic, but basically also on air caps of metal such as, for example, steel (e.g., manganese steel).

The insert 23 could also be bonded into the opening in the sidewall 19 of the horn 14.

Figure 9:
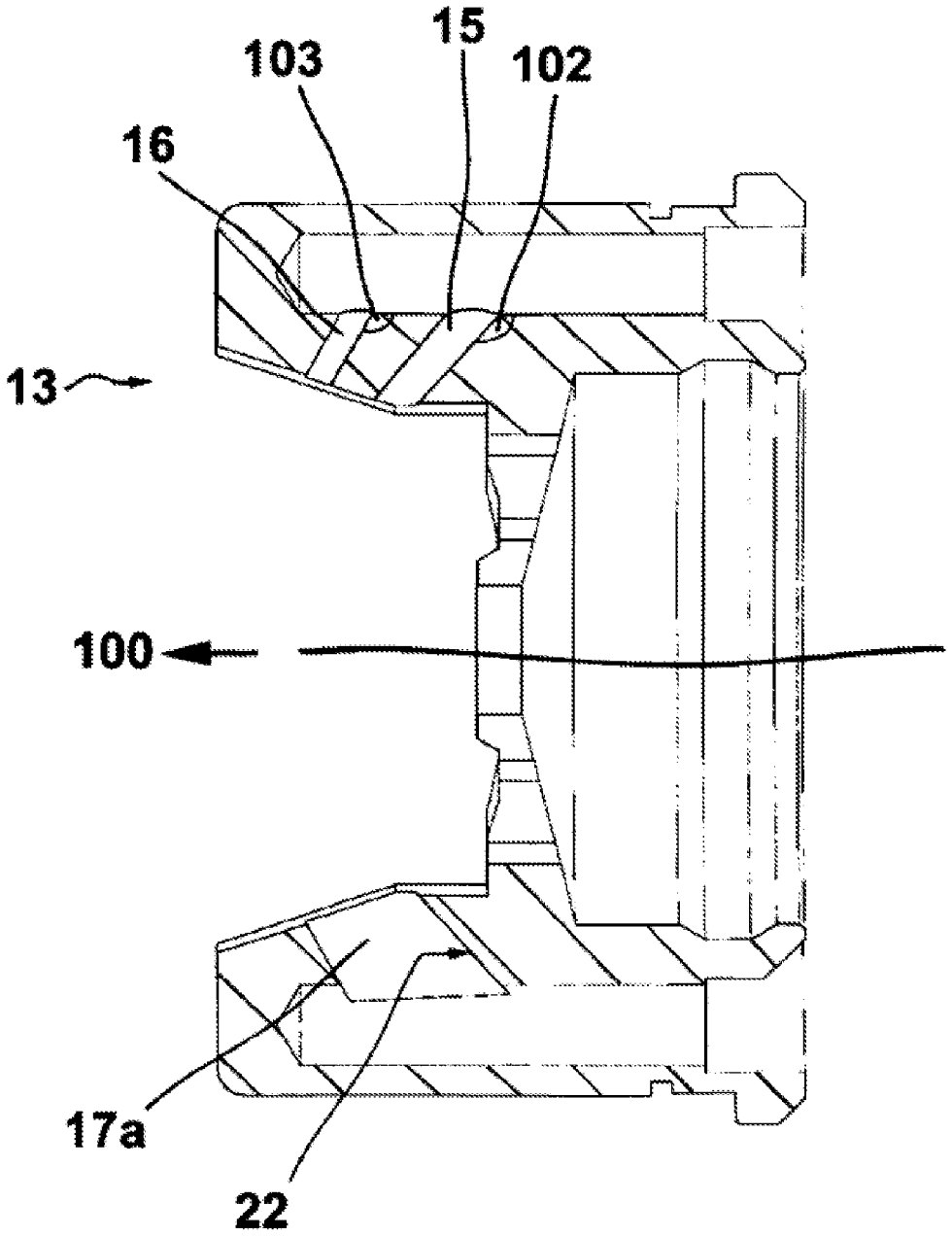

A variant of FIG. 1 is illustrated in the upper half of FIG. 9; identical components are identified by the same reference symbols. In contrast to FIG. 1, the two horn air nozzles 15, 16 of the horn 13 extend at different angles referred to the spray jet direction 100. The angle 102 of the horn air nozzle 15 amounts to approximately 130 degrees while the angle 103 of the horn air nozzle 16 amounts to approximately 120 degrees.

A variant of a portion of the embodiment according to FIG. 4 is illustrated in the lower half of the sectional representation in FIG. 9. This figure clearly shows that the flow surface 22 of the horn air nozzle 17*a* is realized in a smooth fashion in the vertical direction of the horn air nozzle 17*a* or in the spray jet direction 100.

Figure 10:
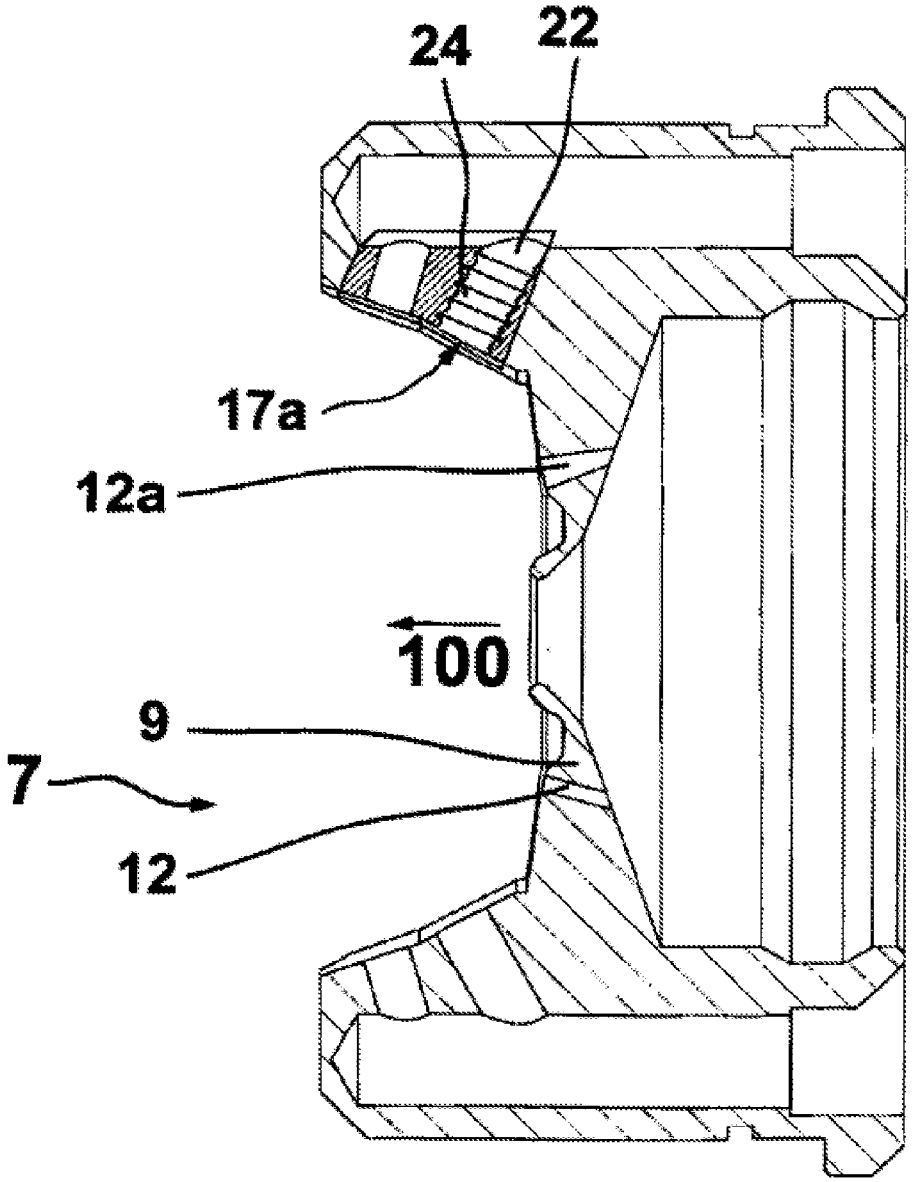
Figure 11:
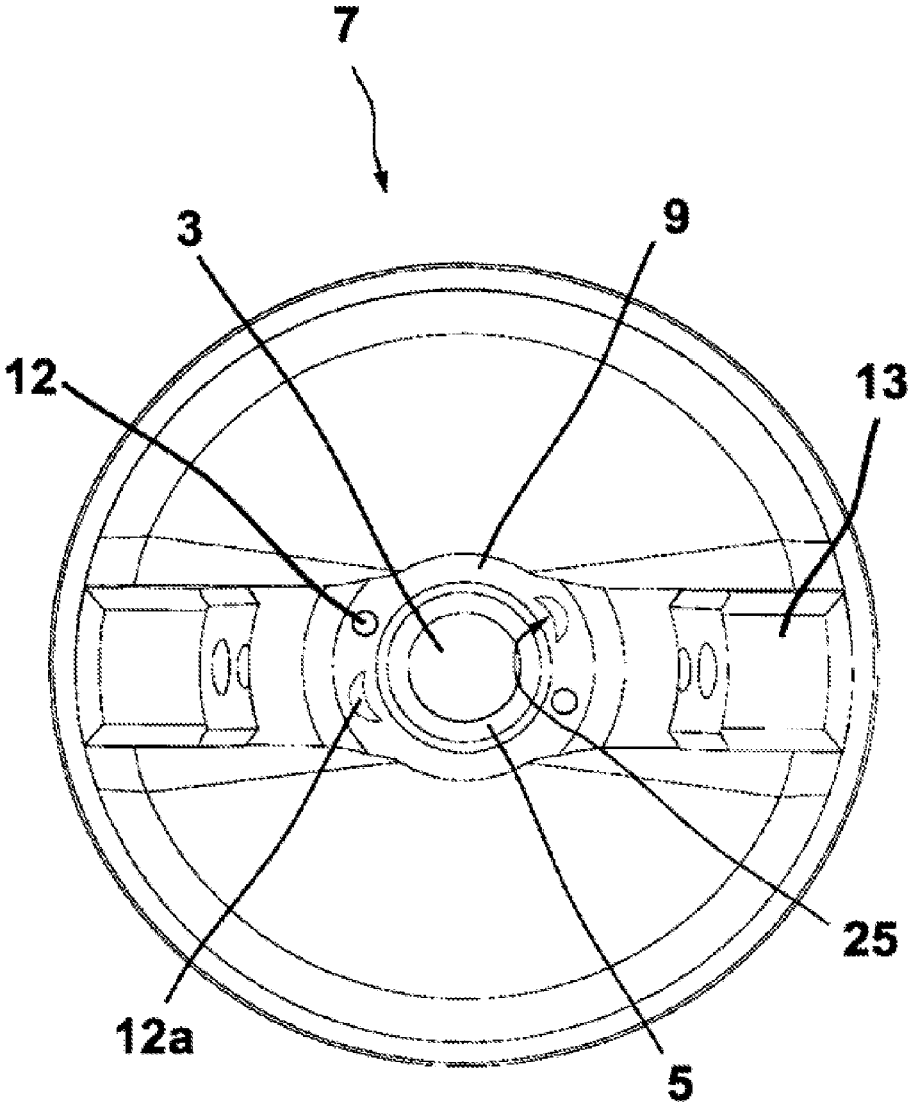

FIG. 10 shows a variant of FIG. 8 and FIG. 4. This figure clearly shows that the flow surface 22 of the horn air nozzle 17*a* may also be realized in a transversely fluted fashion in the vertical direction of this horn air nozzle 17*a* and feature a plurality of flow-conveying grooves 24 for the horn air. The grooves 24 may be realized in the form of longitudinal grooves in another embodiment. Furthermore, control openings or control nozzle openings 12, 12*a* are also provided in this case. The control nozzle openings 12, 12*a* are aligned at an angle referred to the spray jet direction 100. A few control openings or control nozzle openings 12*a* provided in the cover plate 9 of the air cap 7 are not conventionally realized cylindrically, but rather with a diameter that conically widens in the spray jet direction 100. In a top view, the control nozzle openings 12*a* are realized in an approximately lunulate fashion as illustrated in FIG. 11. The inner curvature of each crescent 12 points toward the air ring nozzle 5 or toward the paint nozzle opening 3 in this case. One, two or more control nozzle openings may be provided per side and realized with arbitrary cross sections; the invention is not limited in the number of control nozzle openings. In the present exemplary embodiment, four control nozzle openings 12 and 12*a* are provided in pairs in areas of the cover plate 9 of the air nozzle 7 that lie adjacent to the horns 12, 13. In this case, a cylindrical control nozzle opening 12 respectively lies adjacent to a non-cylindrical control nozzle opening 12*a*. However, it would also be conceivable to provide only non-cylindrical or only cylindrical control nozzle openings.

It would also be possible to provide lamellae, nubs or the like instead of the transverse grooves 24 or longitudinal grooves.

Figure 12:
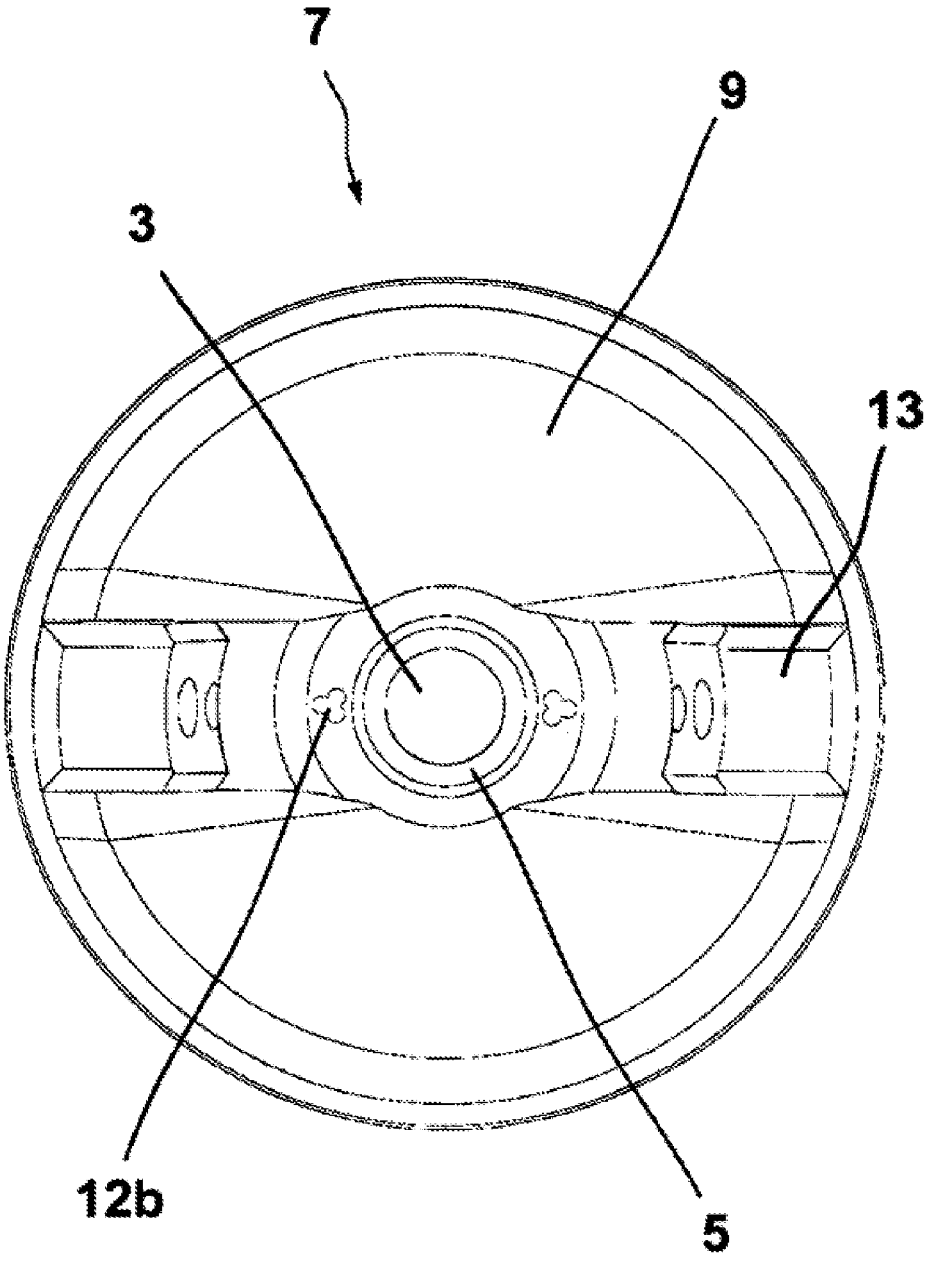

In the variant according to FIG. 12, only two control openings 12*b* are provided instead of four control openings, wherein these two control openings are realized even more irregular than in the above-described embodiments. In a top view or outline, they approximately have the shape of a three-leaf clover. The two control openings 12*b* are provided adjacent to the horns 13, 14 on the cover plate 9 of the air cap 7, namely adjacent to the paint nozzle 3 and the air ring nozzle 5.

Special fluidically optimized channels for the horn air are created with the above-described cross-sectional shapes of the horn air nozzles. It would naturally also be possible to realize other cross-sectional shapes and combinations thereof.

Figure 13:
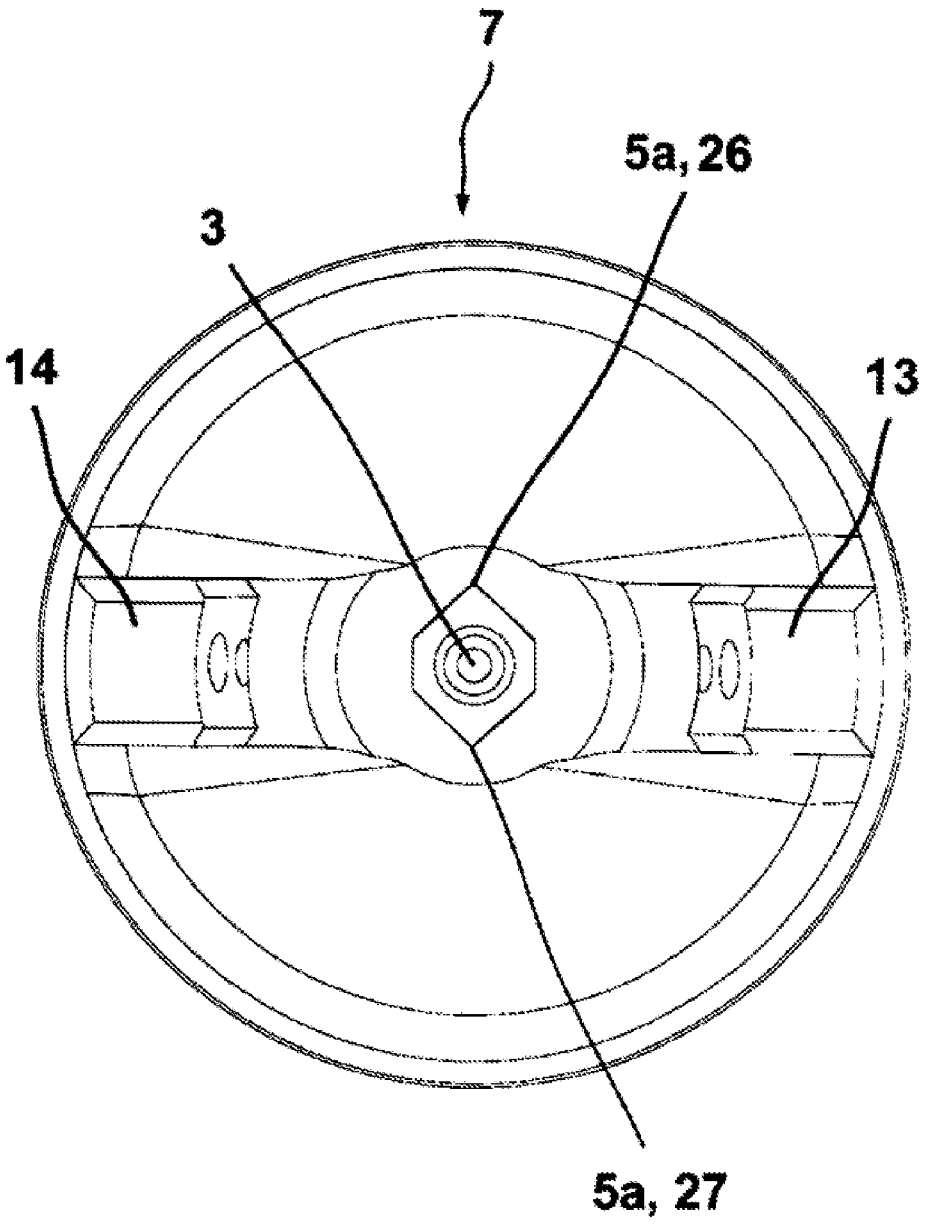

FIG. 13 shows a variant of an air cap 7, in which the air ring nozzle extending around the paint nozzle 3 is not conventionally realized cylindrically. In a top view, the air ring nozzle 5*a* has an approximately hexagonal shape with two peaks 26, 27 in this case. The peaks 26, 27 face away from the horns 13, 14 in this embodiment. In another embodiment, the peaks 26, 27 could also face the horns 13, 14.

Figure 14:
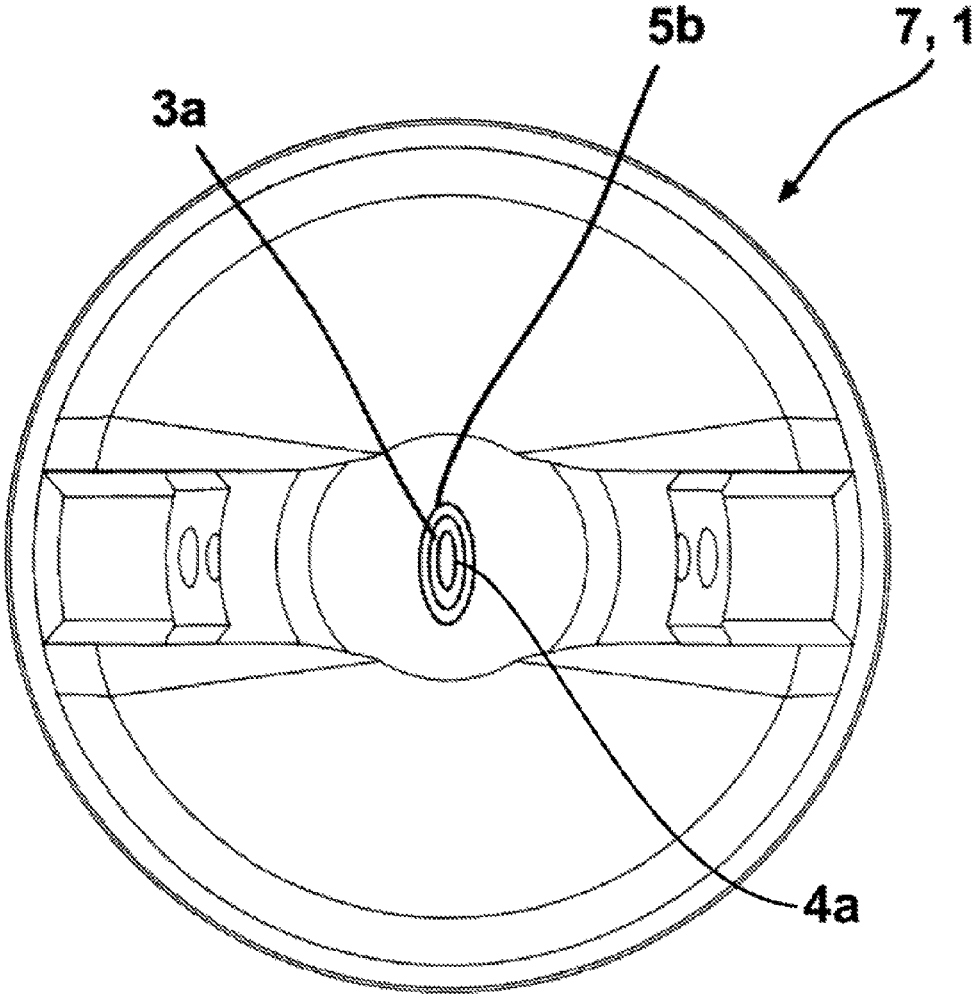

FIG. 14 shows another air ring nozzle 5*b* that has a strictly oval shape in a top view in combination with a likewise shaped paint nozzle 3*a* on an air cap 7 of a nozzle head 1.

In the last two variants, the round jet is pre-formed due to the special shaping in such a way that less horn air than usual is required for the formation of the broad jet.

Other embodiments of the nozzle head with a different air cap or even without [an] air cap are conceivable; in the context of the invention, the non-cylindrical openings in the nozzle head are of essential importance.

Figure 15:
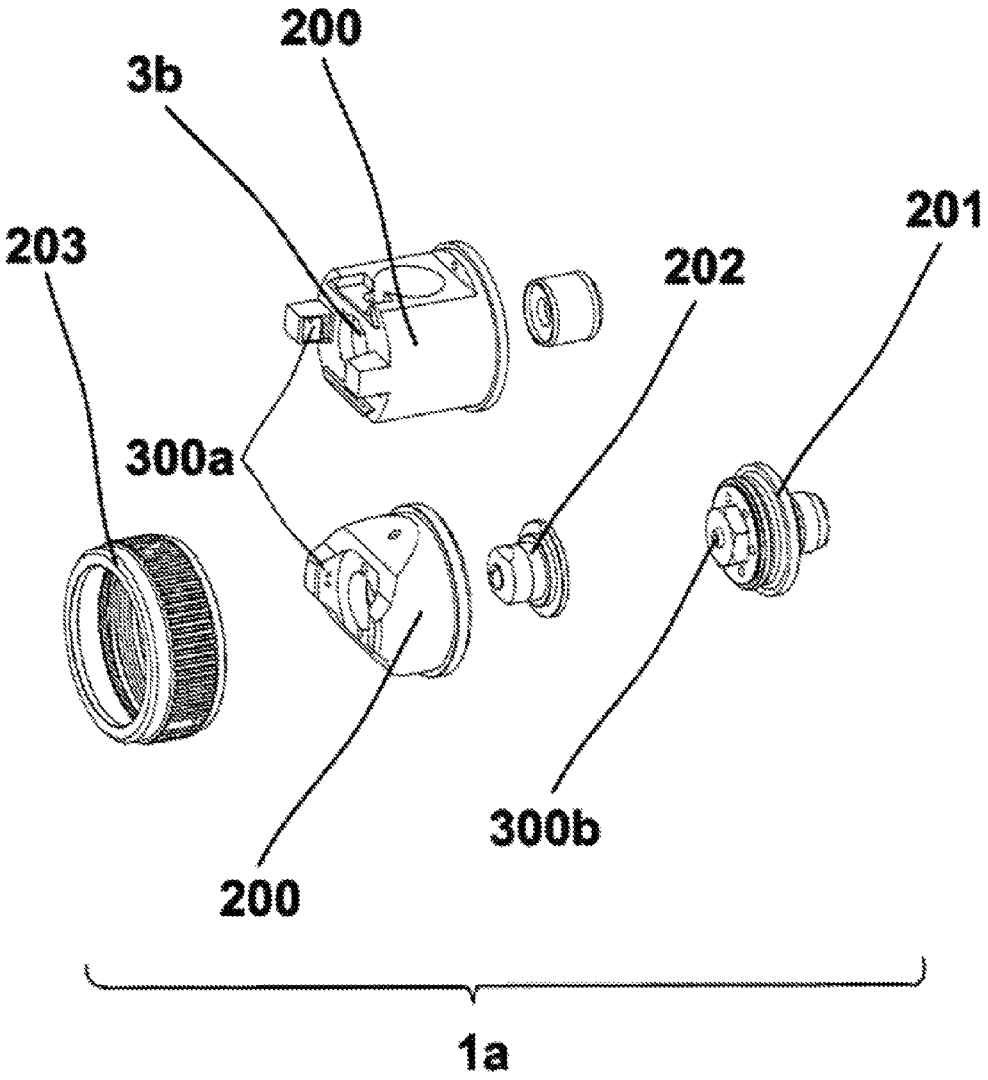
FIG. 15 shows an exploded view of another nozzle head.

The nozzle head 1*a* illustrated in FIG. 15 forms part of a special high-pressure gun that is ideal for processing large quantities of highly viscous materials because it operates with auxiliary air atomization. The nozzle head 1*a* features a so-called air nozzle 200 and a so-called preliminary nozzle 201 that engages into the air nozzle 200 by means of an attachment 202. These components can be screwed on the body of the not-shown spray gun by means of a so-called air nozzle ring 203. In such spray guns, all air-conveying and material-conveying openings or nozzles are usually realized cylindrically. The material is discharged from the central nozzle 3*b* in the form of a flat jet and subsequently shaped into a round jet. It is proposed to realize at least one of the openings 300*a*, 300*b* or air-conveying or material-conveying nozzles, particularly the horn air nozzles 300*a*, in a non-cylindrical fashion. Due to this measure, special effects can also be realized in this case.

Arbitrary combinations of the described nozzle variants naturally are possible and may lead to particularly advantageous spraying results.

All combinations of cylindrical and non-cylindrical nozzles are conceivable in dependence on the desired work result and fall under the scope of the present invention.

The invention naturally is not limited to the above-described nozzle heads. It can also be advantageously utilized in other nozzle heads.

The proposed non-cylindrical nozzles naturally can be produced in a particularly simple fashion in nozzle heads or parts of nozzle heads that are made of plastic, particularly injection-molded. In nozzle heads that are entirely or partially made of metal (usually special steel), non-cylindrical nozzles can be realized by means of lost-wax casting or with the aid of inserts.

In other embodiments, the air nozzle/air ring nozzle may also be directly attached, clipped or screwed on the paint nozzle or installed or mounted thereon in a different way. The air nozzle and the paint nozzle may also be realized in one piece.

The entire nozzle device could be directly connected to a gun body 400 with or without an additional carrier device 402, as shown diagrammatically in FIGS. 17-18.

In another embodiment, the nozzle device respectively is directly connected to the compressed air network and a material supply.

In another embodiment, the nozzle device may also represent part of the air supply or the material supply.

The external shape of the nozzle device may also have arbitrary geometric shapes in the circumferential direction; in one particular embodiment, the entire spray device may have arbitrary geometric shapes.

The openings for the jet formation, as well as the horn air nozzles or horn outlet openings, do not necessarily have to be provided in projecting horns, but may also be arranged, for example in the plate 9, in lateral elevations, in tubes or in a circumferential ring around the plate.

The number of openings in the horns, as well as for the jet formation, is basically arbitrary; several openings may be combined in segments and arranged, for example, in areas that lie opposite one another (90 degrees, 45 degrees, 30 degrees, . . . ). In this case, particular jet shapes can be realized by means of individual openings, several or many openings.

Due to the described and other conceivable fluidically optimized nozzle openings, the energy of the compressed air can be more optimally utilized, the jet can be formed in a superior fashion and the atomization can be improved. In addition to achieving finer droplets, this also makes it possible to improve the droplet distribution in the jet and to realize a more uniform droplet distribution center. It is likewise possible to reduce the dependence of the jet on other parameters such as, e.g., the supply pressure, the material viscosity and manufacturing tolerances, and to diminish the noise by reducing the discharge speed and the compressed air demand.

The invention claimed is:

1. A nozzle head for a spray device, comprising:

a liquid conveying channel having a liquid conveying nozzle opening;

a hollow air conveying needle connected to a source of compressed air and disposed within the liquid conveying channel and having a non-cylindrical shaped air conveying opening at an endmost tip of the needle, the needle displaceable to block the liquid conveying channel while not blocking the air conveying opening at the endmost tip;

an air ring nozzle surrounding said liquid conveying channel; and at least two horns projecting laterally and away from the liquid conveying channel, each horn having a plurality of non-circular air horn nozzles each having a longer axis that is perpendicular to a shorter axis, and the longer axis is aligned with a direction of spray of the liquid when the device is spraying the liquid.

2. The nozzle head of claim 1, wherein the non-cylindrical shaped air conveying opening is oval shaped.

3. The nozzle head of claim 1, wherein the plurality of air horn nozzles each have an opening which is oval in shape.

4. The nozzle head of claim 1, further including a plurality of air discharging control nozzles disposed radially with respect to the hollow air conveying needle and liquid conveying channel.

5. The nozzle head according to claim 1, wherein the air ring nozzle has a non-cylindrical shape.

6. The nozzle head according to claim 1, further comprising at least one control opening with a non-cylindrical shape provided adjacent to the air ring nozzle.

7. The nozzle head according to claim 1, wherein the at least one of the non-circular air horn nozzles is mounted on the nozzle head by means of an insert.

8. The nozzle head according to claim 1, wherein at least one of the nozzles is realized with an elliptical cross section.

9. The nozzle head according to claim 1, wherein the internal size of the nozzles is widened or tapered along the longitudinal direction.

10. The nozzle head according to claim 1, wherein the air ring nozzle is recessed into the nozzle head or a component connected thereto.

11. The nozzle head according to claim 1, wherein at least one nozzle is formed within an insert connectable to the nozzle head or to a component connected thereto.

12. The nozzle head according to claim 1, wherein at least one nozzle is recessed into an air cap of a paint spray gun.

13. The nozzle head according to claim 1, wherein the needle is mateably seatable in the nozzle head to block the liquid conveying channel.

14. The nozzle head according to claim 1, wherein one or more control nozzles are provided.

15. The nozzle head according to claim 1, wherein the air ring nozzle is attached, clipped or screwed onto the spray device.

16. The nozzle head according to claim 15, wherein the air ring nozzle is realized in one piece with a portion of the spray device.

17. The nozzle head according to claim 1, wherein the nozzle head is at least partially made of plastic.

18. The nozzle head according to claim 17, wherein the nozzle head includes an air cap that is made of plastic.

19. The nozzle head according to claim 17, wherein a nozzle-guiding insert in the nozzle head is made of plastic.

20. The nozzle head according to claim 18, wherein the nozzle head is otherwise made of metal.

21. The nozzle head according to claim 1, wherein the nozzle head is directly connected to a body of the spray device.

22. The nozzle head according to claim 1, wherein the nozzle head is connected to a separate device which is connected to the body of the spray device.

23. The nozzle head according to claim 1, wherein the spray device is a pneumatic spray gun.

24. The nozzle head according to claim 1, wherein the spray device is a hydrostatic spray gun.

25. The nozzle head according to claim 1, wherein the spray device is a combined pneumatic/hydrostatic spray gun.

* * * * *